United States Patent [19]

Holsonbake

[11] Patent Number: 4,699,275

[45] Date of Patent: Oct. 13, 1987

[54] APPARATUS FOR SEPARATING FOREIGN BODIES FROM GRANULAR FEEDS

[75] Inventor: David W. Holsonbake, Bakersfield, Calif.

[73] Assignee: International Minerals & Chem. Corp., Terre Haute, Ind.

[21] Appl. No.: 791,932

[22] Filed: Oct. 28, 1985

[51] Int. Cl.[4] ..... B07B 13/00

[52] U.S. Cl. ..... 209/616; 198/598; 209/654; 209/663; 209/931

[58] Field of Search ..... 209/615, 616, 651–654, 209/663, 671, 688, 361, 931, 656, 658; 198/598

[56] References Cited

U.S. PATENT DOCUMENTS

| | | | |
|---|---|---|---|
| 2,114,263 | 4/1938 | Heaslet | 209/616 |
| 2,656,921 | 10/1953 | Gray et al. | 209/616 |
| 2,828,012 | 3/1958 | Komuchar | 209/615 |
| 2,861,685 | 11/1958 | Cordis | 209/616 |
| 2,964,181 | 12/1960 | Demarest et al. | 209/654 |
| 3,024,903 | 3/1962 | Jamal | 209/688 X |
| 3,198,259 | 8/1965 | Manuel | 209/616 X |
| 3,211,188 | 10/1965 | Peis | 209/616 |
| 3,583,564 | 6/1971 | Seesen et al. | 209/616 |
| 4,541,532 | 9/1985 | Wilson | 209/663 X |

FOREIGN PATENT DOCUMENTS

| | | | |
|---|---|---|---|
| 0080050 | 2/1920 | Fed. Rep. of Germany | 198/598 |
| 0512397 | 11/1930 | Fed. Rep. of Germany . | |
| 0189337 | 5/1937 | Switzerland | 209/663 |

*Primary Examiner*—Robert B. Reeves
*Assistant Examiner*—Edward M. Wacyra
*Attorney, Agent, or Firm*—Robert H. Dewey; Thomas L. Farquer

[57] ABSTRACT

An apparatus for separating larger foreign bodies from a granular feed including a conveyor for moving a mixture of the larger foreign bodies and the granular feed, is provided. The apparatus comprises a wheel having an axis of rotation, a circumference and a plurality of outwardly extending resilient fingers, preferably projecting at a trailing angle from the circumference. The wheel is mounted so that its plane forms an angle with respect to the direction of travel of the conveyor. The wheel is positioned so that the conveyed mixture contacts and pushes the fingers causing the wheel to rotate and the fingers to rake the larger foreign bodies from the mixture.

6 Claims, 4 Drawing Figures

APPARATUS FOR SEPARATING FOREIGN BODIES FROM GRANULAR FEEDS

BACKGROUND OF THE INVENTION

1. Field of the Invention

The present invention relates to an apparatus and method for separating larger foreign bodies from granular feeds, and more specifically, relates to an apparatus for separating rocks and other waste debris from finer conveyed granular feed.

2. Description of the Prior Art

The art discloses a number of apparatus for separating stones and other debris from recently harvested potatoes. For example, U.S. Pat. Nos. 2,114,263; 2,656,921; 2,828,012; 3,198,259 and 3,211,288 all disclose various types of apparatus of the above-mentioned type. Several of the above listed patents disclose apparatus utilizing rotating cylindrical brushes mounted above a conveyor carrying the potatoes, stones, and other debris. The axis of the cylindrical brush is at an angle with respect to the direction of travel of the conveyor.

German Pat. No. 512,397 discloses a rotating shaft having a number of radially extending paddles attached thereto. The shaft with the paddles is positioned over a trough carrying mined coal. The paddles are of varying length in order to separate the chunks of mined coal into various size ranges.

There has been a need in the art of conveying granular materials, especially granular materials having a size in the range of less than about 3 Tyler mesh, for a device capable of economically separating and removing oversized foreign objects from the granular feeds.

In past years, petroleum coke which had become contaminated with dirt and other foreign materials, could not be sufficiently cleaned for its intended uses as a fuel. Thus in past years, contaminated coke was disposed of, typically by burial. Recently, new methods of purifying contaminated coke have been developed. Furthermore, the economic value of petroleum coke has risen dramatically over the years. In addition, stricter environmental laws now discourage the disposal of petroleum coke products by burial. As a result of these influences, contaminated petroleum coke which until recently had been discarded and buried, is now being reclaimed for use as fuels. Of course, in reclaiming buried petroleum coke, significant amounts of rock and other foreign materials are also gathered. Thus, there has been a need in the art of reclaiming contaminated petroleum coke for an economical method of separating larger foreign bodies from granulated petroleum coke having a size in the range of less than about 3 Tyler mesh.

While the prior art discloses various screening steps for removing larger foreign bodies from a granular material, these screening steps are extremely expensive from a material processing cost standpoint. Thus, it is a further object of the present invention to provide a more economical means for removing larger foreign bodies from a finer granular feed.

SUMMARY OF THE INVENTION

These and other objects of the present invention are met by an apparatus for separating larger foreign bodies from a granular feed including a conveyor for moving a mixture of the foreign bodies and the granular feed. The apparatus comprises a wheel having an axis of rotation, a circumference and a plurality of material engaging means comprising outwardly extending resilient fingers, preferably projecting at a trailing angle from the circumference. The wheel is mounted so that the plane of the wheel forms an angle with respect to the direction of travel of the conveyor. This angle is referred to herein as the mounting angle. The wheel is positioned so that the conveyed mixture contacts and pushes the fingers to cause the wheel to rotate and the fingers to rake the foreign bodies from the mixture.

Figure 1:
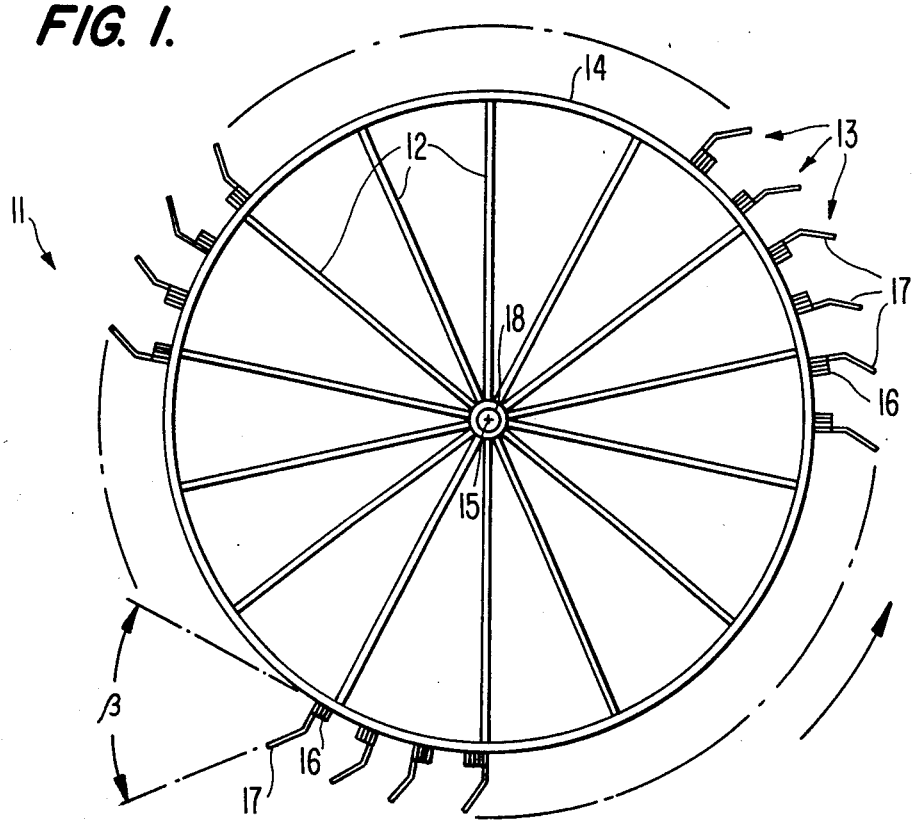
FIG. 1 is a side elevational view of a portion of one embodiment of the present invention.

Although specific forms of apparatus have been selected for illustration in the drawings, and although specific end uses, namely the separation of rocks, wood, trash, blacktop and other debris from reclaimed contaminated petroleum coke, has been selected for description in the specification which follows, it will be appreciated by those skilled in the art that these are merely examples of the wide range of end uses of the present invention whose scope is defined in the appended claims.

DETAILED DESCRIPTION

Referring now to the drawings wherein like reference numerals refer to the same structures in the several drawings, there is shown separation apparatus 10. Apparatus 10 comprises a wheel 11 having a hub 18, a rim 14 and a plurality of spokes 12 extending between hub 18 and rim or circumference 14. Wheel 11 is mounted, on the end of an "s" shaped arm 31, for rotation about axis 15. Arm 31 is fixedly attached to movable beam 32 which can be raised or lowered in order to optimally position wheel 11 with respect to belt 21.

Figure 4:
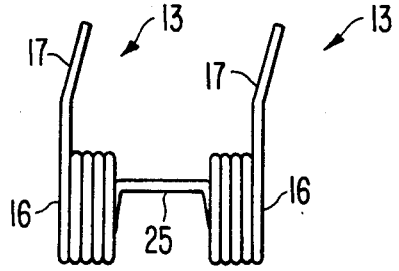
FIG. 4 is a front elevational view of suitable material engaging means.

Attached to rim 14 are a plurality of material engaging means comprising outwardly extending resilient fingers 13. Fingers 13 are composed of spring steel rods, one end of which is fixedly attached to rim 14, the other end 17 extending out from rim 14. Intermediate the two end portions, the steel rod is wound into a spring coil 16, imparting additional resiliency to the fingers 13. As will be recognized by those skilled in the art, it also is possible to make two adjacent fingers 13 from a single spring steel rod, as shown in FIG. 4. The unitary assembly can then be affixed to the rim or circumference 14 of wheel 11 at intermediate section 25 by a suitable bracket (not shown).

Applicant has found that with a circumferential spacing of about 6 inches between adjacent fingers 13 on a wheel having about a 4.5 to 5.5 feet diameter it is possible to remove essentially all objects greater than about 4 inches and the majority of objects 3 to 4 inches in size from belt 21, while retaining substantially all objects less than about 1.5 inches.

As shown in FIG. 1, the extending portions 17 of the fingers 13 preferably form a trailing angle beta of about 45°–55°, more preferably about 50°, with respect to a line tangent to the rim 14. The term "trailing angle" refers to the angle formed between the extending portion 17 of a finger 13 and a line tangent to the rim or circumference 14 opposite to, or on the "trailing" side of, the direction of rotation of wheel 11 as shown in FIG. 1. By orienting the fingers 13 at a trailing angle of about 50°, there is a much less likelihood of "skewering" trash and other debris carried upon conveyor 20. In addition, the trailing angle ensures that any material that is accidently skewered by the fingers 13 will tend to slide off the extending portion 17 as the wheel 11 rotates.

Figure 2:
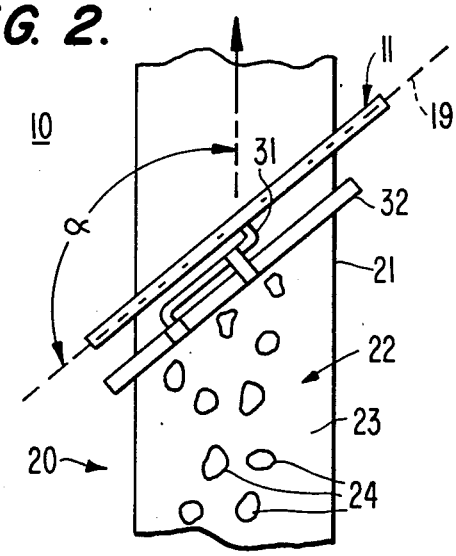
FIG. 2 is a top view of an embodiment of the present invention.

As shown in FIG. 2, wheel 11 is mounted above a conveyor 20 preferably comprising an endless belt 21 carrying a mixture 22. In the illustrated embodiments, the axis 15 of wheel 11 is oriented parallel to the plane of conveyor 20. Mixture 22 may contain granular petroleum coke 23 having a size in the range of 3 Tyler mesh or less and larger foreign bodies 24 such as rocks, wood, trash, blacktop, and other foreign materials.

The wheel 11 is positioned in vertical relation to the conveyor 20 so that the ends of fingers 13 extend into the conveyed mixture 22. As will be discussed hereafter, due to the mounting angle (alpha) of wheel 11 and the forward motion of conveyor 20, the force exerted on the fingers 13 of the wheel 11 by the mixture 22 causes wheel 11 to rotate. As wheel 11 rotates, the fingers 13 are caused to rake through the mixture 22, thereby separating out large foreign objects 24 from the mixture 22 and raking them off belt 21. The rate of rotation of wheel 11 is determined in large part by the rate of movement of conveyor 20.

As is clearly shown in FIG. 2, the plane 19 of wheel 11 forms a mounting angle (alpha) with respect to the direction of travel of belt 21. Angle alpha is preferably in the range of about 110°–160°, more preferably about 130°. At mounting angles of less than about 110°, wheel 11 is not easily turned by the conveyed material. At mounting angles of greater than about 160°, the ability of wheel 11 to rake any foreign object 24 contained in the mixture 22 a significant distance toward the edge of belt 21 significantly declines. Preferably, the apparatus includes means permitting adjustment of the mounting angle of the wheel.

Figure 3:
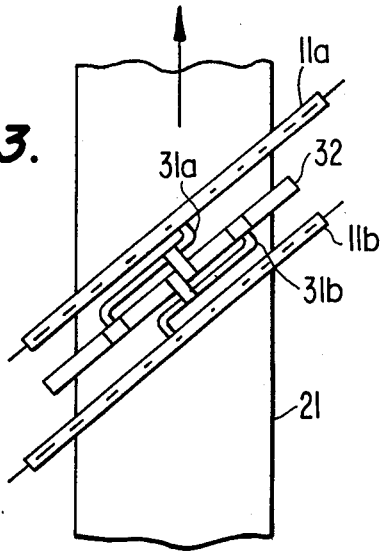
FIG. 3 is a top view of another embodiment of the present invention.

FIG. 3 illustrates a preferred embodiment of the apparatus of the present invention utilizing two identical wheels 11*a,b* mounted in parallel on beam 32 by arms 31*a,b*. All other features of the FIG. 3 embodiment are the same as in FIGS. 1 and 2.

Those skilled in the art will readily appreciate that any number of wheels 11 may be parallelly mounted and that the parameters of the apparatus 10, such as the spacing of the fingers, the resiliency of the fingers, the length of the fingers, the trailing angle (beta) of the fingers, the wheel mounting angle (alpha), the speed of the conveyor belt 21, as well as other parameters may be adjusted in order to optimize the separating capabilities of apparatus 10. For instance, by decreasing the spacing between adjacent fingers 13 or by increasing the mounting angle (alpha), it becomes possible to separate out smaller foreign bodies. Conversely, as the spacing between the adjacent fingers 13 increases, the apparatus 10 becomes more selective and will only separate out larger foreign bodies.

Although the invention has been described in connection with the separation of large rocks, and other debris from petroleum coke having a size in the range of 3 Tyler mesh or less, it will be readily appreciated by those skilled in the art that the present invention can be used to separate any number of materials in various size ranges. Furthermore, although the apparatus described separates out large foreign bodies to be discarded, it is within the scope of the present invention to utilize such an apparatus to remove large particles of value from a finer granular waste material. These and many other variations of the present invention will be readily apparent to those skilled in the art.

I claim:

1. An apparatus for separating larger bodies from a granular feed, including a belt conveyor for moving a mixture of said larger bodies and granular feed, a wheel having an axis of rotation and a circumference, the wheel being positioned above the conveyor and forming a mounting angle with respect to the conveyor, comprising a plurality of outwardly extending resilient fingers projecting from the circumference at a trailing angle in the range of about 45°–55°, whereby the projecting fingers contact the conveying mixture, the movement of which pushes the fingers causing the wheel to rotate and the fingers to rake the larger bodies from the mixture.

2. The apparatus as defined in claim 1, wherein said wheel has a diameter of about 4.5 to 5.5 feet and adjacent fingers are separated by a distance of about 6 inches along the circumference.

3. The apparatus as defined in claim 1, wherein each of the fingers comprises a metal rod having two end portions, the first end portion being secured to the circumference, the second end portion extending outwardly from the circumference, and a coiled portion intermediate said two end portions for providing resiliency to the fingers.

4. The apparatus as defined in claim 1, including means for adjusting the angular position of the plane of the wheel with respect to the direction of movement of the conveyor.

5. The apparatus as defined in claim 1, including means for adjusting the vertical position of the wheel with respect to the conveyor.

6. The apparatus defined in claim 1, wherein two adjacent fingers are made from a single metal rod having two end portions extending outwardly from the circumference, and two coiled portions intermediate said two end portions for providing resiliency to the fingers.

* * * * *